United States Patent [19]

Ikeda et al.

[11] Patent Number: 4,853,323

[45] Date of Patent: Aug. 1, 1989

[54] SILVER HALIDE EMULSION

[75] Inventors: Hideo Ikeda; Shuzo Suga; Nobuaki Miyasaka, all of Minami-Ashigara, Japan

[73] Assignee: Fuji Photo Film Co., Ltd., Minami-ashigara, Japan

[21] Appl. No.: 919,136

[22] Filed: Oct. 15, 1986

[30] Foreign Application Priority Data

Oct. 16, 1985 [JP] Japan ..... 60-230828

[51] Int. Cl.[4] ..... G03C 1/10

[52] U.S. Cl. ..... 430/569; 430/599; 430/603

[58] Field of Search ..... 430/599, 603, 569, 607

[56] References Cited

U.S. PATENT DOCUMENTS

| | | | |
|---|---|---|---|
| 2,380,280 | 7/1945 | Weyerts | 430/599 |
| 2,448,534 | 9/1948 | Lowe et al. | 430/603 |
| 2,666,700 | 1/1954 | Baldsieten | 430/599 |
| 3,320,069 | 5/1967 | Illingsworth | 430/603 |
| 3,772,031 | 11/1973 | Berry et al. | 430/603 |
| 4,111,697 | 9/1978 | Pollet et al. | 430/607 |

*Primary Examiner*—Richard L. Schilling

*Attorney, Agent, or Firm*—Burns, Doane, Swecker & Mathis

[57] ABSTRACT

The present invention relates to a silver halide emulsion containing a thiocyanate and having a high sensitivity in particular to light of a low illuminance. According to the present invention, a silver halide emulsion is provided, wherein the IR absorbance at 2052 $cm^{-1}$ due to thiocyanate ion contained in the silver halide grain of the emulsion is observed and a tricarboxylic acid or its salt is contained in the emulsion.

18 Claims, No Drawings

SILVER HALIDE EMULSION

BACKGROUND OF THE INVENTION (1) Field of the Invention

The present invention relates to a silver halide emulsion. More particularly, the present invention relates to a silver halide emulsion having a high sensitivity, particularly, high sensitivity to light of low illuminance.

(2) Prior Art

It is a universal demand in the field of silver halide photographic sensitive materials to obtain a photosensitive material having a high sensitivity. Various techniques have been proposed and patented already. One of these is a technique disclosed in U.S. Pat. No. 3,320,069 in which a thiocyanate is used in a step of forming emulsion grains. It is also disclosed in the specification of Japanese Patent Application No. 60-158891 (U.S. Ser. No. 886,052) that the control of IR absorbance at 2052 $cm^{-1}$ of a thiocyanate in silver halide grains is important for photographic sensitivity, pressure resistance, etc. when the thiocyanate is used in the formation of the grains. However, sufficient sensitivity has yet to be obtained by these processes in particular sensitivity to light of a low illuminance has been unsatisfactory.

SUMMARY OF THE INVENTION

The present invention was made in order to resolve the above problems.

The object of the present invention is to provide a silver halide photographic emulsion having a high sensitivity particularly to light of a low illuminance by using a thiocyanate in the formation of emulsion grains.

According to the present invention, a silver halide emulsion containing thiocyanate ion is provided, wherein an absorbance due to the thiocyanate ion is observed at 2052 $cm^{-1}$ as measured by infrared spectroscopic analysis of the silver halide grains contained in the silver halide emulsion and a substituted or unsubstituted and saturated or unsaturated tricarboxylic acid or its salt is contained in the emulsion.

The present inventors have made intensive study and unexpectedly found that the present invention provides a silver halide photographic light-sensitive material having a high sensitivity and in particular high sensitivity to light of low illuminance.

DETAILED DESCRIPTION OF THE INVENTION

The thiocyanate ion contained in the present emulsion grains are supposed to exist in three different states corresponding to IR absorption peaks at 2106, 2073 and 2052 $cm^{-1}$, respectively, each suggesting the state of the thiocyanate ion in the silver halide grains. It is supposed that teh peak at 2106 $cm^{-1}$ corresponds to a state of the thiocyanate ion adsorbed on the grain surfaces, the peak at 2073 $cm^{-1}$ corresponds to another state of the ion adsorbed on the grain surfaces or the state existing on its subsurface, and the peak at 2052 $cm^{-1}$ corresponds to the ion incorporated in the grains.

The maximum position i.e. (2052 $cm^{31\ 1}$) of the thiocyanate ion varies by about $\pm 10$ $cm^{-1}$ depending on the composition of the halogen in the silver halide grains or the amount of the thiocyanate ion.

When 10 mg of the silver halide of the silver halide emulsion of the present invention containing the thiocyanate is tableted into a disc having a diameter of 2.5 mm and analyzed according to the infrared spectroscopic method, the absorbance of the thiocyanate ion at 2052 $cm^{-1}$ is preferably at least 0.002, particularly at least 0.015 and usually up to 0.2.

More particularly, the infrared spectroscopic absorbance of the thiocyanate in the silver halide grains can be determined by the process described below. The process is carried out preferably with a safety lamp.

First, a commercially available protease is reacted with the emulsion or emulsion-coated body and then the silver halide grains are separated from the binder and washed thoroughly with distilled water. If a sharp IR absorption peak at 2052 $cm^{-1}$ does not actually appear because it overlaps the skirts of the peaks at 2106 and 2073 $cm^{-1}$, the grains are washed with a bromide solution and then with distilled water to substantially weaken the absorption at 2106 $cm^{-1}$ and 2073 $cm^{-1}$ and to sharpen the peak at 2052 $cm^{-1}$. Thus, the absorbance at 2052 $cm^{-1}$ can be clearly observed. The thus treated product is dried well to obtain a silver halide powder.

Then, 10 mg of the silver halide powder is molded into a tablet having a diameter of 2.5 mm with a tableting machine. To maintain the influence of the pressure at a constant level, a pressure of 250 kg and a pressing time of 1 min. are employed for the tablet having a diameter of 2.5 mm.

In the determination of the infrared spectroscopic absorption of the obtained silver halide tablet, a Fourier transformation IR spectrograph with a solving power of 4 $cm^{-1}$ is used and the absorbance in the range of 4000 to 400 $cm^{-1}$ is determined.

According to a thiocyan process, the absorbance at around 2052 $cm^{-1}$ is determined by connecting the absorbance peak at 2120 $cm^{-1}$ with that at 2020 $cm^{-1}$ by a straight line to form a base line and then measuring the difference between the line and top of the peak at around 2052 $cm^{-1}$.

The tricarboxylic acid or its salt to be used in the present invention can be incorporated during the emulsion in or after the grain formation step, in a desalting step (washing step with water), chemical ripening (after-ripening), in any step immediately before the application, or in all the steps. In the above steps, the tricarboxylic acid or its salt is preferably used for pH control.

It has been well known in the art that the pH control in both the precipitate-forming step and after-ripening in the preparation of emulsions is one of the factors exerting great influence on the emulsion properties. In the precipitation method which is the main process employed in the desalting step, an inorganic salt of a polyvalent anion such as sodium sulfate, an anionic surfactant, an anionic polymer (for example, polystyrenesulfonic acid), or a gelatin derivative (for example, an aliphatic acylated gelatin, an aromatic acylated gelatin, or an aromatic carbamoylgelatin) is used and the pH is controlled to usually 3 to 4.5. Finally, the pH of the emulsion is controlled to 5 to 8. Therefore, an acid is used usually in the preparation of the emulsion.

The substituents of the tricarboxylic acid or its salt to be used for controlling pH in the present invention include, for example, a halogen atom (such as chlorine and bromine) and a hydroxy group. Examples of the tricarboxylates include salts thereof with alkali metals such as sodium and potassium, and ammonium.

Typical examples of the above-mentioned tricarboxylic acids are as follows. These examples, however, by no means limit the scope of the invention:

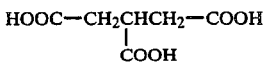

(1)

1,2,3-tricarboxypropane

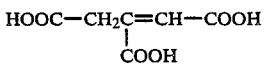

(2)

1,2,3-tricarboxy-1-propene

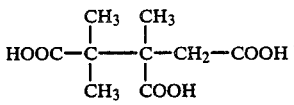

(3)

1,2,3-tricarboxy-1,1,2-trimethylpropane

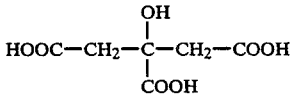

(4)

1,2,3-tricarboxy-2-hydroxypropane

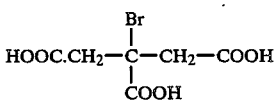

(5)

1,2,3-tricarboxy-2-bromopropane

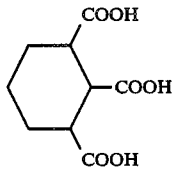

(6)

1,2,3-tricarboxycyclohexane

The amount of the acid to be used in the present invention varies depending on the pH buffering capacity of the reaction system (more particularly, it depends on the amount of, for example, a tribasic additive such as a tribasic polymer, e.g. gelatin or $NH_3$ to be used as the solvent for the silver halide). For changing the pH by at least 1, 2.0 to $10^{-3}$ mol of the acid is usually used per mol of the silver halide. When the acid is used prior to the desalting step, the final concentration is reduced to 1/10 to $1/10^3$ of the original concentration by the dilution effect of the desalting step. In the final emulsion, the acid is present in the form of its potassium, ammonium salt, etc.

The silver halide or its salt contained which is present in the emulsion in an amount of 2.0 to $10^{-6}$ mol per mol of the silver halide, can be easily detected by ordinary liquid chromatography. In this process, a water-soluble component is extracted from the emulsion with water. When its concentration is low, it is concentrated, if necessary, with a freeze-dry process. Then, the extract is analyzed using chromatography. When an inhibiting component is contained therein in a large amount, a polybasic carboxylic acid ion is preferably separated by adsorption and desorption with an ion exchange resin or an ion exchange celluluse such as an anion exchange cellulose. The chromatographic analysis can be effected by a reversed phase chromatography method with ODS (octadecylsilica) or the like, or ion chromatography with 2010-i device (a product of Dionex Co.).

When the polybasic carboxylic acid or its salt is to be detected or determined with more sensitivity, it can be analyzed using chromatography combined with a colorimetric analysis such as that disclosed in "Kosoku ekitai Chromatography Data-shu" pp. 68 to 69 supervised by Tanimura and published by Saiwai Shobo.

To be able to detect the IR absorption due to the thiocyanate ion in the silver halide grains at 2052 $cm^{-1}$ in the preparation of the silver halide emulsion of the present invention, it is necessary that the thiocyanate is incorporated therein at least before completion of the formation of the silver halide grains.

It is preferred that the thiocyanate is present in the reaction vessel before at least 95% of the water-soluble silver salt is added is more preferred that it is present therein before at least 90% of said water-soluble silver salt is added. It is particularly preferred that the thiocyanate is present therein before the grain formation is started.

The smaller the excess amount of the halide in the precipitation step in the presence of the thiocyanate, the higher the absorbance of thiocyanate ion at 2052 $cm^{-1}$.

The thiocyanates used in the present invention are alkali metal salts thereof such as NaSCN and KSCN, and water-soluble salts such as $NH_4SCN$.

The amount of the thiocyanate to be used is preferably in the range of 0.5 to 60 molar %, more preferably 2 to 40 molar %, based on the water-soluble silver salt to be used.

In the photographic emulsion to be used in the present invention, used is any silver halide selected from the group consisting of silver bromide, silver iodobromide, silver iodochlorobromide, silver chlorobromide and silver chloride. The preferred halide is silver iodobromide or silver iodochlorobromide containing up to 30 molar % of silver iodide. Particularly preferred is silver iodobromide containing 2 to 25 molar % of silver iodide.

The silver halide grains in the photographic emulsion may be so-called regular crystalline grains such as cubes, octahedrons and tetradecahedrons, irregular crystalline grains such as spheres, those having crystalline defects such as twinning planes, and the complex grains thereof.

The silver halide grains may be fine grains having a diameter of less than 0.1 μm or large grains having a diameter of the projected area of up to 10 μm. The emulsion may be either a monodisperse emulsion having a narrow grain size distribution, or a polydisperse emulsion having a wide grain size distribution.

The silver halide photographic emulsion of the present invention can be prepared by a known process such as that disclosed in "Research Disclosure (RD)", No. 17643 (December, 1978), pp. 22 to 23 (I. Emulsion preparation and types) and RD, No. 18716 (November 1979) pp. 648. More particularly, any process such as an acid process, a neutral process and an ammonia process, etc. may be employed. The soluble silver salt can be reacted with the soluble halogen salt by any processes such as a single jet process, a double jet process, or the combination thereof. A so-called back mixing process wherein the grains are formed in the presence of an excess amount of silver ion may also be employed. One of the simultaneous mixing process is a so-called "controlled double jet process" wherein pAg in the silver halide-forming liquid phase is kept constant. This process provides the silver halide emulsion containing the silver halide grains having a regular crystalline form and a substantially uniform grain size.

Two or more silver halide emulsions formed separately may be used in the form of their mixture.

The silver halide emulsion containing the abovementioned regular grains is obtained by controlling the pAg and pH in the course of the formation of the grains. More particularly, this process is described in "Photographic Science and Engineering" 6, 159–165 (1962); "Journal of Photographic Science", 12, 242–251 (1964); and the specifications of U.S. Pat. No. 3,655,394 and British Pat. No. 1,413,748.

A typical example of the monodisperse emulsions is that comprising silver halide grains having an average grain diameter larger than about 0.1 μm, in which at least 95 wt. % of the silver halide grains have diameter in the range of ±40% of the average grain diameter. The emulsion usable in the present invention has an average grain diameter of 0.25 to 2 μm wherein at least 95 wt. % or at least 95% in number of the silver halide grains have a diameter in the range of ±20% of the average grain diameter. Processes for preparing such an emulsion are disclosed in the specifications of U.S. Pat. Nos. 3,574,628 and 3,655,394, and British Patent No. 1,413,748. The monodisperse emulsions mentioned in, for example, the specifications of Japanese Patent Disclosure Nos. 48-8600, 61-39027, 51-83097, 53-137133, 54-48521, 54-99419, 58-37635, and 58-49938, are preferably used in the present invention.

Tabular grains having an aspect ratio of 5 or higher can also be used in the present invention. These grains can be prepared easily by processes disclosed in Gutoff, "Photographic Science and Engineering", 14, 248 to 257 (1970); and the specifications of U.S. Pat. Nos. 4,434,226, 4,414,310, 4,433,048 and 4,439,520 and British Patent No. 2,112,157. It is described in detail in U.S. Pat. No. 4,434,226 that the tabular grains are effective for improving the spectral sensitization efficiency with the sensitizing dye, graininess, and sharpness.

The crystalline structure may be homogeneous, or heterogeneous so that the halogen composition of the surface of the crystal is different from that in the core thereof, or it may have a laminar structure. These emulsion grains are disclosed in the specifications of British Pat. No. 1,027,146, U.S. Pat. Nos. 3,505,608 and 4,444,988, and Japanese Patent Disclosure No. 60-143331. The crystals of different silver halides may be bonded together by an epitaxial structure, or they may be bonded with a compound other than silver halides such as silver rhodanide or lead oxide. These grains are described in the specifications of U.S. Pat. Nos. 4,094,684, 4,142,900, 4,459,353, 4,349,622, 4,395,478, 4,433,501, 4,463,087, 3,656,962 and 3,852,067; British Patent No. 2,038,792; and Japanese Patent Disclosure No. 59-162540.

A mixture of grains having various crystalline forms may also be used.

The silver halide grains may be formed or physically ripened in the presence of a cadmium salt, zinc salt, lead salt, thallium salt, iridium salt or its complex salt, rhodium salt or its complex salt, or iron salt or its complex salt.

In the formation of the silver halide grains used in the present invention, a solvent for the silver halide can be used for controlling the grain growth. Examples of these solvents include ammonia and thioether compounds (see, for example, the U.S. Pat. Nos. 3,271,157, 3,574,628, 3,704,130, 4,297,439 and 4,276,347), thion compounds (see, for example, the specifications of Japanese Patent Disclosure Nos. 53-144319, 53-82408 and 55-77737) and amine compounds (see, for example, the specification of Japanese Patent Disclosure No. 53-100717). Among these solvents, ammonia is particularly preferred for the emulsion of the present invention. The concentration of ammonia is preferably in the range of $1\times10^{-2}$ to 10 mol/mol-Ag.

The silver halide emulsion to be used in the present invention may be chemically sensitized.

The chemical sensitization can be effected by an ordinary sulfur sensitization, reduction sensitization, noble metal sensitization, or a combination thereof. Examples of the chemical sensitizers include sulfur sensitizers such as allyl thiocarbamide, thiourea, thiosulfates, thioethers and cystine; noble metal sensitizers such as potassium choloroaurate, aurous thiosulfate and potassium chloropalladate; and reduction sensitizers such as tin chloride, phenylhydrazine and reductones.

Various hydrophilic colloids can be used as binders in the photographic emulsion of the present invention.

The colloids usable for this purpose include hydrophilic colloids generally to be used in the photographic field, for example, gelatin, colloidal albumin, polysaccharides, cellulose derivatives, synthetic resins such as polyvinyl compounds including polyvinyl alcohol derivatives and acrylamide polymers. Hydrophobic colloids such as dispersed polymerized compounds, particularly those capable of improving the dimensional stability of the photographic material, can be used together with the hydrophilic colloids. Suitable examples of these compounds include water-insoluble polymers prepared by polymerizing vinyl monomers such as alkyl acrylates, alkyl methacrylates, acrylic acid, sulfoalkyl acrylates and sulfoalkyl methacrylates. Other polymers such as dextran may also be used together.

Various compounds can be added to the above photographic emulsions for preventing the lowering of the sensitivity or the fogging during the preparation of the sensitive materials, storage or treatment. As for these compounds, various compounds have been known for a long time such as heterocyclic compounds, mercury-containing compounds, mercapto compounds and metal salts. They include, for example, 4-hydroxy-6-methyl-1,3,3a,7-tetrazaindene, 3-methylbenzothiazole and 1-phenyl-5-mercaptotetrazole.

Any antifoggants well known in the art and usable in the present invention are mentioned in K. Mees "The Theory of the Photographic Process", 3, (1966) with reference to the original texts as well as in the specifications of Japanese Patent Disclosure Nos. 49-81024, 50-6306 and 50-19429; and U.S. Pat. No. 3,850,639.

An antistatic agent, particularly a low molecular or high molecular fluorine compound, may be incorporated in the photographic emulsion of the present invention, or at least one of the layers of the photographic sensitive material prepared by using the photographic emulsion.

The fluorine-containing low molecular compounds are mentioned in the specifications of U.S. Pat. Nos. 3,775,126, 3,589,906, 3,798,265, 3,779,768 and 4,407,937; West German Patent No. 1,293,189; British Patent Nos. 1,259,398, 58,431, 1,330,356 and 1,417,915; Japanese Patent Disclosure Nos.48-87826, 49-10722, 49-46733, 50-16525, 50-113221, 50-161236, 50-99525, 51-7917, 51-32322, 51-106419, 51-151124, 51-151125, 51-151126, 51-151127, 51-129229, 52-127974, 53-8471, 53-146622, 54-14224, 54-48520, 55-7762, 56-114944, 58-16233 and 59-23344; and Japanese Patent Publication Nos. 48-43130 and 52-16073; and "Research Disclosure" Nos. 16630, 17341 and 17611.

The fluorine-containing high molecular compounds are mentioned in U.S. Pat. Nos. 4,175,969, 4,087,394, 4,016,125, 3,676,123, 3,679,411 and 3,304,852; Japanese Patent Disclosure Nos. 52-129520, 54-158222, 55-57842, 57-11342, 57-19735 and 57-179837; "Kagaku Sosetsu", No. 27, 'Atarashii Fusso Kagaku (New Fluorine Chemistry)' (edited by Nippon Kagaku Kai, 1980), and Satokawa, "Kinosei Ganfusso Kobunshi (Functional Fluorine-containing Polymers)" (published by Nikkan Kogyo Shinbun-sha in (1982).

The photographic silver halide emulsion layer and another hydrophilic colloid layer in the sensitive material of the present invention can be haredened with a suitable hardener. These hardeners include, for example, vinylsulfonyl compounds; active halogen-containing hardeners; dioxane derivatives; and oxypolysaccharides such as hydroxystarch, which are mentioned in the specifications of Japanese Patent Disclosure Nos. 53-76025, 53-76026 and 53-77619.

The photographic emulsion in the photosensitive material of the present invention may be spectrally sensitized to a blue, green, red or infrared light in a relatively long wave region with a sensitizing dye. The sensitizing dyes include cyanine dyes, merocyanine dyes, complex cyanin dyes, complex merocyanine dyes, holopolar cyanine dyes, styryl dyes, hemicyanine dyes, oxonol dyes and hemioxonol dyes.

The sensitizing dyes used in the present invention are used at a concentration equal to that of usual negative silver halide emulsions. Advantageously, the dye concentration is such that the intrinsic sensitivity of the silver halide emulsion is not substantially reduced. The concentration of the sensitizing dye is about $1.0\times10^{-5}$ to about $5\times10^{-4}$ mol, particularly about $4\times10^{-5}$ to $2\times10^{-4}$ mol, per mol of the silver halide.

The sensitive material according to the present invention may contain in the hydrophilic colloid layer, water-soluble filter dyes for preventing the irradiation or halation or for various other purposes. Examples of these dyes include oxonol, hemioxonol, styryl, merocyanine, cyanine and azo dyes. Among them, oxonol, hemioxonol and merocyanine dyes are particularly useful. When the hydrophilic colloid layer of the sensitive material of the present invention contains a dye or U.V. absorber, it may be mordanted with a cationic polymer or the like.

The sensitive material according to the present invention may contain surfactants for various purposes. Any of nonionic, ionic and ampholytic surfactants may be used depending on the purpose. They include, for example, polyoxyalkylene derivatives and amphoteric aminoacids (including sulfobetaines).

A matting agent and/or lubricant may be incorporated in the emulsion layer or the protective layer of the silver halide sensitive material according to the present invention, preferably in the protective layer. Preferred examples of the matting agents include organic compounds such as water-dispersible vinyl polymers, e.g. polymethyl methacrylate; and inorganic compounds such as silver halides and strontium barium sulfate, which matting agents have a suitable grain diameter (0.3 to 5$\mu$ or at least 2 times or particularly at least 4 times as thick as the protective layer). The lubricants are useful for preventing adhesion troubles like the matting agents and particularly for improving the abrasion properties which are closely related to the fitness of the cinematographic film for the camera during the photographing or projection. Examples include waxes such as liquid paraffin and higher fatty acid esters, polyfluorinated hydrocarbons and their derivatives, and silicones such as polyalkylpolysiloxanes, polyarylpolysiloxanes, polyalkylarylpolysiloxane and their alkylene oxide adducts.

The emulsion of the present invention is usually ripened physically or chemically or, if necessary, spectrally sensitized. The additives to be used in such a step include those mentioned above and, in addition, those mentioned in "Research Disclosure", 176, No. 17643 (December, 1978) and 187, No. 18716 (November, 1979) as summarized in the table given below.

| | Additive | RD 17643 | RD 18716 |
|---|---|---|---|
| 1 | Chemical sensitizer | P.23 | P.648, right column |
| 2 | Sensitizer | | " |
| 3 | Spectral sensitizer | P.23–24 | P.648, right column |
| 4 | Supersensitizier | | P.649, right column |
| 5 | Brightening agent | P.24 | |
| 6 | Antifoggant and stabilizer | P.24–25 | P.649, right column |
| 7 | Coupler | P.25 | |
| 8 | Organic solvent | P.25 | |
| 9 | Light absorber and filter dye | P.25–26 | P.649, right column to P.650, left column |
| 10 | U.V. absorber | | |
| 11 | Antistaining agent | P.25, right column | P.650, left to right column |
| 12 | Dye stability | P.25 | |
| 13 | Hardener | P.26 | P.651, left column |
| 14 | Binder | P.26 | " |
| 15 | Plasticizer, lubricant | P.27 | P.650, right column |
| 16 | Coating aid, surfactant | P.26–27 | " |
| 17 | Antistatic agent | P.27 | " |

The emulsion of the present invention can be used in combination with an emulsion having a different grain size, emulsion having a different crystal habit, emulsion having a different sensitivity, silver halide emulsion the inside of which is fogged, etc. For example, when the emulsion of the present invention is coated in combination with the silver halide emulsion the inside of which is fogged (in the same emulsion layer or adjacent layer), a sensitive material capable of realizing a high maximum density, a high sensitivity and a high gamma image can be provided. Such a combination technique is described in detail in U.S. Pat. Nos. 2,996,382, 3,398,987 and 4,459,351; Japanese Patent Disclosure Nos. 58-215647, 59-86039, 59-100438, 59-147350, 60-76737, 60-194443, and 61-48832, and Japanese Patent Application Nos. 60-93328 and 60-144893. The proportion of the sensitive silver halide of the present invention to the silver halide having the fogged inside is variable depending on the type of the emulsion to be used (such as variety of the halogen composition), variety and application of the sensitive material to be used, and contrast of the emulsion to be used. It is preferably 100:1 to 1:100, particularly 10:1 to 1:10. The total amount of silver to be applied is preferably 0.5 to 10 g/m$^2$.

One or multiple layers (such as two or three layers) of the silver halide emulsion of the present invention can be formed on the base if necessary, in combination with another, emulsion. The layers can be formed, not only on one surface but also on both surfaces of the base. Emulsions having different color sensitivities can be applied to obtain an interlayer effect.

The silver halide emulsion of the present invention can be used for the preparation of black and white silver halide photographic sensitive materials (such as X-ray sensitive material, lithographic sensitive material and black and white photographing negative film) and color photographic sensitive materials (such as negative color film, reversal color film and color paper) as well as diffusion transfer sensitive materials (such as diffusion transfer color element and silver salt diffusion transfer element) and heat developing sensitive materials (such as black and white sensitive mateirals and color sensitive materials).

EXAMPLES

The following examples will further illustrate the present invention. However, these examples are not intended to limit the scope of the present invention in any way.

EXAMPLE 1

(1) Preparation of emulsions and coated samples

Emulsions 1 to 8 containing a silver halide in which an absorption at 2052 $cm^{-1}$ due to thiocyanate ion was detectable by the infrared spectral method were prepared as follows:

An aqueous solution of 320 g of $AgNO_3$ was added over 7 min. to an aqueous solution comprising 160 g of inert gelatin, 64 g of KI, 360 g of KBr, 77.6 g of KSCN, and 280 cc of a 25 wt. % aqueous $NH_3$ solution and being kept at 50° C. Then, an aqueous solution of 1280 g of $AgNO_3$ and an aqueous solution of 840 g KBr were added thereto over 20 min. and the mixture was physically ripened for 35 min. The thus obtained silver halide emulsion was divided into 8 equal portions. 2.5 g of a naphthalenesulfonate/formalin condensate was added to each portion, the pH of which was controlled to 4.4 with various acids shown in Table 1. It was desalted by the precipitation method for 2 hr. The dilution rate of the water-soluble substance was 1/400. Then, the pH was controlled to 6.8 and the emulsion was chemically sensitized by the gold/sulfur sensitization method using chloroauric acid and sodium thiosulfate. 4-Hydroxy-6-methyl-1,3,3a,7-tetrazaindene was added thereto as the stabilizer, to obtain sensitive silver iodobromide emulsions 1 to 8 (silver iodide content: 4 molar %) having an average grain size of 0.9μ.

Separately, emulsions 9 to 12 containing a silver halide having no absorption at 2052 $cm^{-1}$ due to thiocyanate ion when detected by the infrared spectral method, were prepared as follows:

An aqueous solution of 160 g of $AgNO_3$ was added over 7 min. to 4 l of an aqueous solution comprising 80 g of inert gelatin, 32 g of KI, 180 g of KBr and 140 cc of a 25 wt. % aqueous $NH_3$ solution and being kept at 65° C. Then, an aqueous solution containing 640 g of $AgNO_3$ and an aqueous solution containing 420 g of KBr were added thereto over 20 min. and the resultant mixture was physically ripened for 35 min. The thus obtained silver halide emulsion was divided into 4 equal portions. 2.5 g of a naphthalenesulfonate/formalin condensate was added to each portion, the pH of which was controlled to 4.4 with various acids shown in Table 1. It was desalted by the precipitation method. The dilution rate of the water-soluble substance was 1/400. Then, the same procedure used in the preparation of the emulsions 1 to 8 was repeated to obtain sensitive silver iodobromide emulsions 9 to 12 (silver iodide content: 4 molar %) having an average grain size of 0.9μ.

p-Vinylbenzene sulfonate as the thickening agent, an oxamonomethinecyanine dye and 4,5-dihydro-2,4-diphenyl-5-phenylimino-1H-triazolium inner salt salycylate as photographic property-improvers, and a vinylsulfone compound as the hardener were added to each of the thus obtained emulsions 1 to 12 to obtain the coating emulsions. These coating emulsions were each applied to an under-coated polyester base uniformly. A surface-protecting layer was formed thereon by applying an aqueous gelatin solution containing polymethyl methacrylate having an average grain diameter of 3μ as the matting agent, a compound obtained by adding ethylene oxide to a condensate of an alkylphenol and ketone, $C_8F_{17}SO_2N(C_3H_7(CH_2COOK$ and $C_8F_{17}SO_2N(C_3H_7)(CH_2CH_2O)NH$ as the antistatic agents, and Snowtex as the film quality-improver, to obtain coated samples 1 to 12.

The amount of the coated silver in each of the samples 1 to 12 was 3.5 $g/m^2$, that of the coated gelatin in the protective layer was 1.1 $g/m^2$, and that of the coated gelatin in the emulsion layer was 2.5 $g/m^2$.

(2) Determination of infrared spectral absorption of the grains in the emulsion

Each of the emulsion 1 to 12 was treated with Pronase P (a protease of Kaken Kagaku Co., Ltd.) at 40° C. for 2 hr. to decompose the gelatin. The mixture was centrifuged to precipitate the silver halide and then the supernatant liquid was removed. Then, the redispersion of the precipitate in distilled water and centrifugation thereof were repeated to was the silver halide grains. The grains were further washed with a 10 g/l aqueous KBr solution on a filter paper, washed with distilled water, and then dried. 10 mg of the thus obtained silver halide powder was pressed with a microtablet-forming machine (MPD-1) (a product of Hitachi, Ltd.) under a total pressure of 250 kg for 1 min. to obtain a tablet having a diameter of 2.5 mm. In the determination of the infrared spectral absorption, 40 time integration was effected using a Fourier transformation infrared spectrograph (JIR 40 by Nippon Denshi Co., Ltd., resolving power: 4 $cm^{-1}$ and range: 4000 to 400 $cm^{-1}$). The light source was a Globar lamp (a silicon type exothermic element), the detector was TGS (triglycine sulfate), and the beam condenser was IRB-2 (a product of Hitach, Ltd.). As for the absorbance at around 2052 $cm^{-1}$ due to thiocyanic acid, a difference in the absorbance between a base line obtained by connecting a point at 2120 $cm^{-1}$ with a point at 2020 $cm^{-1}$ by a straight line and the peak top at 2052 $cm^{-1}$ was determined.

(3) Evaluation of the coated samples

Pieces of the coated sample Nos. 1 to 12 prepared in (1) were wedge-exposed to a light of $10^{-1}$ sec. After realizing a running state, they were developed at 35° C. for 25 sec. with an automatic developing machine (FPM-4000 automatic developing machine of Fuji Film Co., Ltd.) and a developer having the following composition and then fixed, washed with water, dried and subjected to the sensitometry.

| (Composition of the developer) | |
|---|---|
| potassium hydroxide | 29.14 g |
| glacial acetic acid | 10.96 g |
| potassium sulfite | 44.20 g |
| sodium bicarbonate | 7.50 g |
| boric acid | 1.00 g |
| diethylene glycol | 28.96 g |
| ethylenediaminetetraacetic acid | 1.67 g |
| 5-methylbenzotriazole | 0.06 g |
| 5-nitroindazole | 0.25 g |

-continued

| (Composition of the developer) | |
|---|---|
| hydroquinone | 30.00 g |
| 1-phenyl-3-pyrazolidone | 1.50 g |
| glutaraldehyde | 4.39 g |
| sodium metabisulfite | 12.60 g |
| potassium bromide | 7.00 g |
| water | at 1 l |

pH of the composition was controlled to 10.25.

Separately, other pieces of the coated sample Nos. 1 to 12 were wedge-exposed to light for $10^3$ sec. (illuminance: 1/10000), and treated in the same manner as above, to determine the sensitivity thereof to the low illuminance exposure.

The results are summarized in Table 1.

TABLE 1

| Coated sample No. | Absorbance of grains in the emulsion at 2052 $cm^{-1}$ | Acid used in the desalting step: Variety | Acid used in the desalting step: Amount (mol) | Residue of the acid in the final emulsion (mol/mol-AgX) | Photographic properties after exposure for 1/10 sec.: Fog | Sensitivity* | Gamma | Maximum density | Sensitivity to light of low illuminance upon 1000 sec. exposure* | |
|---|---|---|---|---|---|---|---|---|---|---|
| 1 | 0.020 | $H_2SO_4$ | $2.1 \times 10^{-1}$ | $4.3 \times 10^{-4}$ | 0.03 | 100 | 1.5 | 2.4 | 40 | Comparative |
| 2 | " | $HNO_3$ | $2.9 \times 10^{-1}$ | $6.2 \times 10^{-4}$ | 0.04 | 93 | " | " | 23 | " |
| 3 | " | $H_3PO_4$ | $2.7 \times 10^{-1}$ | $5.7 \times 10^{-4}$ | " | 115 | " | " | 73 | " |
| 4 | " | acetic acid | 1.0 | $2.1 \times 10^{-3}$ | 0.03 | 107 | " | " | 60 | " |
| 5 | " | maleic acid | $4.1 \times 10^{-1}$ | $8.7 \times 10^{-4}$ | 0.02 | 107 | " | 2.5 | 60 | " |
| 6 | " | compound (1) | $3.0 \times 10^{-1}$ | $6.4 \times 10^{-4}$ | 0.03 | 141 | " | 2.4 | 138 | Present Invention |
| 7 | " | compound (2) | $2.7 \times 10^{-1}$ | $5.7 \times 10^{-4}$ | " | 141 | " | " | 138 | " |
| 8 | " | compound (4) | $2.9 \times 10^{-1}$ | $6.2 \times 10^{-4}$ | 0.04 | 145 | " | " | 141 | " |
| 9 | 0 | $H_2SO_4$ | $2.0 \times 10^{-1}$ | $4.3 \times 10^{-4}$ | 0.03 | 79 | 1.4 | " | 28 | Comparative |
| 10 | " | acetic acid | 1.0 | $2.1 \times 10^{-3}$ | " | 81 | " | " | 28 | " |
| 11 | " | compound (1) | $3.0 \times 10^{-1}$ | $6.4 \times 10^{-4}$ | " | 81 | " | " | 30 | " |
| 12 | " | compound (4) | $2.9 \times 10^{-1}$ | $6.2 \times 10^{-4}$ | 0.04 | 81 | " | " | 30 | " |

*The sensitivity was the relative sensitivity, taking the sensitivity of the coated sample 1 to the light upon exposure for 1/10 sec. as 100.

It is apparent from Table 1 that the coated sample Nos. 6 to 8 in which the absorption at around 2052 $cm^{-1}$ due to the thiocyanate ion in the grains in the emulsion was detectable by the infrared spectral method and which were prepared by using the emulsion containing the tricarboxylic acid as the acid used in the desalting step according to the present invention, had a high sensitivity, particularly a high sensitivity to the light of the low illuminance. On the other hand, the coated sample Nos. 1 to 5 in which the absorption at around 2052 $cm^{-1}$ was detectable but which were prepared by using an emulsion containing an acid other than the tricarboxylic acid of the present invention, had a low sensitivity, particularly a low sensitivity to the light of the lower illuminance. The coated samples 9 to 12 prepared by using the emulsion in which the absorption at around 2052 $cm^{-1}$ was not detected, had far lower sensitivity, particularly far lower sensitivity when exposed to the light of the low illuminance and the influence of the variety of the acid used in the desalting step was not remarkable.

EXAMPLE 2

(1) Preparqation of emulsions and coated samples

Emulsions 13 to 17 containing a silver halide in which an absorption at 2052 $cm^{-1}$ due to thiocyanate ion was detectable by the infrared spectral method were prepared as follows:

An aqueous solution containing 250 g $AgNO_3$ complexed with 2 equivalents of $NH_3$ and aqueous solution containing 180 g of KBr were simultaneously added over 10 min. to 5 l of an aqueous solution containing 100 g of inert gelatin, 20 g of KI and 48.5 g of KSCN and being kept at 75° C. The thus obtained seed emulsion was rapidly divided into 5 equal portions. An acid shown in Table 2 was added to each portion to control the pH to 5.5. Then, an aqueous solution containing 150 g of neutral $AgNO_3$ an an aquous solution containing 114 g of KBr were simultaneously added to each emulsion over 20 min. and the emulsion was ripened for 35 min. 2.5 g of naphthalenesulfonic acid/formalin condensate was added thereto and the pH thereof was controlled to 4.4 with sulfuric acid. It was desalted by the precipitation method. The dilution rate of the water-soluble substance was 1/400. The emulsion was chemically sensitized by the gold/sulfur sensitization method using chloroauric acid and sodium thiosulfate. 4-Hydroxy-6-methyl-1,3,3a,7-tetrazaindene was added thereto as the stabilizer to obtain sensitive silver iodobromide emulsions 13 to 17 (silver iodide content: 2 molar %) having an average grain size of 1.1μ.

Separately, emulsions 18 to 21 containing a silver halide in which no absorption at 2052 $cm^{-1}$ due to thiocyanate ion was detectable by the infrared spectral method were prepared as follows:

An aqueous solution containing 200 g of $AgNO_3$ complexed with 2 equivalents of $NH_3$ and an aqueous solution containing 144 g of KBr were simultaneously added over 10 min. to 4 l of an aqueous solution containing 80 g of inert gelatin and 16 g of KI and being kept at 75° C. The thus obtained seed emulsion was divided into 4 equal portions. 25 min. after the completion of the above addition, an acid shown in Table 2 was added to each emulsion, to control the pH to 5.5. Then, an aqueous solution containing 150 g of neutral $AgNO_3$ and an aqueous solution containing 114 g of KBr were simultaneously added to each emulsion over 20 min. and the emulsion was ripened for 35 min. The desalting, washing and subsequent tretments were effected in the same manner as in the preparation of the emulsions 13 to 17, to obtain sensitive silver iodobromide emulsions 18 to 21 (silver iodide content: 2 molar %) having an average grain size of 1.1μ.

A dodecylbenzenesulfonate as the coating aid, p-vinylbenzenesulfonate as the thickening agent, a vinylsulfon compound as the hardener, and 4,5-dihydro-2,4-diphenyl-5-phenylimino-1H-triazlium inner salt salicylate and a polyethylene oxide compound as the photographic property-improvers were added to each of the emulsions to obtain the coating emulsions. These coating emulsions were each applied to an under-coated polyester base uniformly. A surface-protecting layer was formed thereon by applying an aqueous solution mainly comprising gelatin to obtain coated samples 13 to 21. The amount of the coated silver in the coated samples 13 to 21 was 4.0 g/m$^2$, that of the coated gelatin in the protecting layer was 1.3 g/m$^2$, and that of the coated gelatin in the emulsion layer was 2.7 g/m$^2$.

(2) Determination of infrared spectral absorption of the grain in the emulsion

The method described in Example 1-(2) was employed.

(3) Evaluation of the coated samples

The coated samples 13 to 21 prepared in the above step (1) were subjected to the same experiment as in Example 1-(3), to effect the sensitometry (determination of the sensitivity to light of the low illuminance).

The results are summarized in Table 2.

TABLE 2

| Coated sample No. | Absorbance of grains in the emulsion at 2052 cm$^{-1}$ | Acid used in the desalting step: Variety | Acid used in the desalting step: Amount (mol) | Residue of the acid in the final emulsion (mol/mol-AgX) | Photographic properties after exposure for 1/10 sec.: Fog | Photographic properties after exposure for 1/10 sec.: Sensitivity* | Photographic properties after exposure for 1/10 sec.: Gamma | Photographic properties after exposure for 1/10 sec.: Maximum density | Sensitivity to light of low illuminance upon 1000 sec. exposure* | |
|---|---|---|---|---|---|---|---|---|---|---|
| 13 | 0.015 | $H_2SO_4$ | $1.0 \times 10^{-1}$ | $2.1 \times 10^{-4}$ | 0.04 | 100 | 2.0 | 2.3 | 50 | Comparative |
| 14 | " | acetic acid | $5.0 \times 10^{-1}$ | $1.1 \times 10^{-3}$ | " | 107 | " | " | 56 | " |
| 15 | " | compound (1) | $1.6 \times 10^{-1}$ | $3.4 \times 10^{-4}$ | " | 135 | " | " | 132 | Present Invention |
| 16 | " | compound (4) | $1.5 \times 10^{-1}$ | $3.2 \times 10^{-4}$ | " | " | " | " | 135 | " |
| 17 | " | compound (5) | $1.3 \times 10^{-1}$ | $2.8 \times 10^{-4}$ | 0.03 | 129 | " | " | 123 | " |
| 18 | 0.000 | $H_2SO_4$ | $1.0 \times 10^{31}$ 1 | $2.1 \times 10^{-4}$ | " | 85 | 1.8 | " | 41 | Comparative |
| 19 | " | acetic acid | $5.0 \times 10^{-1}$ | $1.1 \times 10^{-3}$ | 0.04 | " | " | " | " | " |
| 20 | " | compound (1) | $1.6 \times 10^{-1}$ | $3.4 \times 10^{-4}$ | " | " | " | " | 43 | " |
| 21 | " | compound (4) | $1.3 \times 10^{-1}$ | $3.2 \times 10^{-4}$ | " | " | " | " | 45 | " |

*The sensitivity was the relative sensitivity, taking the sensitivity of the coated sample 13 to the light upon the exposure for 1/10 sec. as 100.

It is apparent from Table 2 that the coated sample Nos. 15 to 17 in which the absorption at around 2052 cm-1 due to the thiocyanate ion in the emulsion grains was detectable by the infrared spectral method and which were prepared by using the emulsion containing the tricarboxylic acid in the grain-forming step according to the present invention, had a high sensitivity, particularly a high sensitivity to the light of the low illuminance. On the other hand, the coated sample Nos. 13 and 14 in which the absorption at around 2052 cm$^{-1}$ was detectable but which were prepared by using an emulsion containing an acid other than the tricarboxylic acid of the present invention, had a low sensitivity to particularly the light of the low illuminance. The coated sample Nos. 18 to 21 prepared by using the emulsion in which the absorption at around 2052 cm$^{-1}$ was not detected had far lower sensitivity to particularly the light of the low illuminance and the influence of the variety of the acid used in the grain formation step was not remarkable.

EXAMPLE 3

(1) Preparation of emulsions and coated samples

Emulsions 22 to 25 containing a silver halide in which an absorption at 2052 cm$^{-1}$ due to thiocyanate ion was detectable by the infrared spectral method were prepared as follows:

An aqueous solution containing 160 g of $AgNO_3$ was added over 7 min. to 4 l of an aqueous solution containing 80 g of inert gelatin, 32 g of KI, 180 g of KBr, 38.8 g of KSCN and 140 ml of a 25 wt. % aqueous $NH_3$ solution and being kept at 50° C. Then, an aqueous solution cintaining 640 g of $AgNO_3$ and an aqueous solution containing 420 g of KBr were simultaneously added thereto over 20 min. and the emulsion was physically ripened for 35 min. Then, 5.2 g of p-vinylbenzenesulfonate, 4 g of naphthalenesulfonate/formalin condensate, and 2l of 2.5 M ammonium sulfate were added thereto. After the desalting effected by the precipitation method according to the salting-out technique, the resulting emulsion was divided into 4 equal portions. An acid shown in Table 3 was added to each portion to control the pH to 6.8. Each emulsion was chemically sensitized by the gold/sulfur sensitization method using chloroauric acid and sodium thiosulfate. 4-Hydroxy-6-methyl-1,3,3a,7-tetrazaindene was added thereto as the stabilizer to obtain sensitive silver iodobromide emulsions 22 to 25 (silver iodide content: 4 molar %) having an average grain size of 0.9$\mu$.

A vinylsulfone compound as the hardening agent, and 4,5-dihydro-2,4-diphenyl-5-phenylimino-1H-triazolium inner salt salicylate and an oxamonomethinecyanine dye as the photographic property-improvers were added to each of the emulsions to obtain the coating emulsions. These coating emulsions were each applied to an under-coated polyester base uniformly. The same aqueous gelatin solution as in Example 1-(1) was applied thereto to form a surface-protecting layer, thereby coated samples Nos. 22 to 25 were prepared. The amount of the coated silver in the coated samples 3 and 4 was 3.5 g/m$^2$ and that of the coated gelatin in the protecting layer was 2.5 g/m$^2$.

(2) Determination of infrared spectral absorption of the emulsion grains

The method described in Example 1-(2) was employed.

(3) Evaluation of the coated samples

The coated sample Nos. 22 to 25 prepared in the above step (1) were subjected to the same experiment as in Example 1-(3) to effect the sensitometry (determination of the sensitivity to the light of the low illuminance).

The results are summarized in Table 3.

TABLE 3

| Coated sample No. | Absorbance of grains in the emulsion at 2052 $cm^{-1}$ | Acid used in the desalting step | | Residue of the acid in the final emulsion (mol/mol-AgX) | Photographic properties after exposure for 1/10 sec. | | | | Sensitivity to light of low illuminance upon 1000 sec. exposure* | |
|---|---|---|---|---|---|---|---|---|---|---|
| | | Variety | Amount (mol) | | Fog | Sensitivity* | Gamma | Maximum density | | |
| 22 | 0.020 | $H_2SO_4$ | $4.0 \times 10^{-4}$ | $3.4 \times 10^{-4}$ | 0.03 | 100 | 1.5 | 2.4 | 71 | Comparative |
| 23 | " | acetic acid | $1.2 \times 10^{-3}$ | $1.0 \times 10^{-3}$ | " | " | " | " | 76 | " |
| 24 | " | compound (2) | $4.1 \times 10^{-4}$ | $3.5 \times 10^{-4}$ | " | 123 | " | " | 120 | Present Invention |
| 25 | " | compound (4) | $4.3 \times 10^{-4}$ | $3.7 \times 10^{-4}$ | 0.04 | 126 | " | " | 126 | " |

*The sensitivity was the relative sensitivity, taking the sensitivity of the coated sample 22 to the light upon the exposure for 1/10 sec. as 100.

It is apparent from Table 3 that the coated sample Nos. 24 and 25 in which the absorption at around 2052 cm-1 due to the thiocyanate ion in the emulsion grains was detectable by the infrared spectral method and which were prepared by using the emulsion containing the tricarboxylic acid in the step other than the grain-forming step or desalting step according to the present invention, had a high sensitivity to particularly the light of the low illuminance. On the other hand, the coated samples 22 and 23 prepared by using the emulsion containing an acid other than the tricarboxylic acid of the present invention, had a low sensitivity to particularly the light of low illuminance.

From the results of Examples 1 to 3, it is concluded that the emulsions in which the absorption around 2052 $cm^{-1}$ due to the thiocyanate ion contained in the grains therein was detectable by the infrared spectral method and which were prepared by using the emulsion containing the tricarboxylic acid according to the present invention in any step in the course of the preparation thereof, have a high sensitivity to particularly the light of low illuminance. Thus, the effects of the present invention are remarkable.

What is claimed is:

1. A silver halide emulsion containing a thiocyanate wherein an absorbance of at lest 0.015 due to thiocyanate ion is observed at 2052 $cm^{-1}$ on infrared spectroscopic analysis of the silver halide contained in the silver halide emulsion, and wherein said emulsion contains a substituted or unsubstituted and saturated or unsaturated tricarboxylic acid or its salt.

2. The silver halide emulsion according to claim 1, wherein said thiocyanate is used in an amount of 0.5–60 mol % based on a water-soluble silver salt.

3. The silver halide emulsion according to claim 1 wherein said silver halide is silver iodobromide or iodochlorobromide containing up to 30 molar % of silver iodide.

4. The silver halide emulsion according to claim 1, wherein said thiocyanate is selected from the group consisting of KSCN, NaSCN and $NH_4SCN$.

5. The silver halide emulsion according to claim 2 wherein said thiocyanate is used in an amount of 2–40 mol% based on a water-soluble silver salt.

6. The silver halide emulsion according to claim 1, wherein said tricarboxylic acid is selected from the group consisting of 1,2,3-tricarboxypropane, 1,2,3-tricarboxy-1-propene, 1,2,3-tricarboxy-1,1,2-trimethylpropane, 1,2,3-tricarboxy-2-hydroxypropane, 1,2,3-tricarboxy-2-bromopropane, and 1,2,3-tricarboxycyclohexane.

7. The silver halide emulsion according to claim 1, wherein said tricarboxylic acid or its salt is used in an amount of $2.0–10^{-6}$ mol per mol of the silver halide contained in the emulsion.

8. A process for producing a silver halide emulsion wherein the silver halide grain is formed in the presence of a thiocyanate so that an absorbance of at least 0.015 due to thiocyanate ion is observed at 2052 $cm^{-1}$ on infrared spectroscopic analysis of the silver halide contained in the silver halide emulsion, and a tricarboxylic acid or its salt is added from the beginning of the formation of the silver halide grain to immediately before the application of the emulsion.

9. The process according to claim 8, wherein said thiocyanate is selected from the group consisting of KSCN, NaSCN and $NH_4SCN$.

10. The process according to claim 8, wherein said thiocyanate is used in an amount of 0.5–60 mol 5 based on a water-soluble silver salt.

11. The process according to claim 8, wherein said tricarobyxlic acid is selected from the group consisting of 1,2,3-tricarboxypropane, 1,2,3-tricarboxy-1-propene, 1,2,3-tricarboxy-1,1,2-trimethylpropane, 1,2,3-tricarboxy-2-hydroxypropane, 1,2,3-tricarcoxy-2-bromopropane, and 1,2,3-tricarboxycyclohexane.

12. The process according to claim 8, wherein said tricarboxylic acid or its salt is used in an amount of $2.0–10^{-6}$ mol per mol of the silver halide contained in the emulsion.

13. The process according to claim 8, wherein said thiocyanate is added before at least 95% of the total amount of a water-soluble silver halide is added.

14. The process according to claim 8, wherein said thiocyanate is added before the formation of the silver halide grains is completed.

15. The process according to claim 8, wherein said process comprises a desalting step and said tricarboxylic acid or its salt is added in the desalting step.

16. The process according to claim 8, wherein said tricarboxylic acid or its salt is added when the silver halide grain is formed.

17. The process according to claim 8, wherein said process comprises an after-ripening step and said tricarboxylic acid or its salt is added to the emulsion just before the after-ripening step.

18. The process according to claim 10, wherein said thiocyanate is used in an amount of 2–40 mol % based on a water-soluble silver salt.

* * * * *